US005628270A

United States Patent [19]

Ryll et al.

[11] Patent Number: 5,628,270

[45] Date of Patent: May 13, 1997

[54] CONTINUOUSLY MODULAR FLEXIBLY HINGED MARINE FENDER SYSTEM

[76] Inventors: David L. Ryll, 7670 S. Olive Cir., Englewood, Colo. 80112; Gregory R. Klaes, 55 Hunters Ridge, Orchard Park, N.Y. 14127

[21] Appl. No.: 453,068

[22] Filed: May 26, 1995

[51] Int. Cl.[6] ..... B63B 59/02

[52] U.S. Cl. ..... 114/219

[58] Field of Search ..... 114/219, 220; 405/212; D12/168

[56] References Cited

U.S. PATENT DOCUMENTS

| | | | |
|---|---|---|---|
| 4,343,258 | 8/1982 | Belvedere | 114/219 |
| 4,357,891 | 11/1982 | Sluys | 114/219 |
| 4,584,958 | 4/1986 | Green | 114/219 |
| 5,027,736 | 7/1991 | Drews | 114/219 |
| 5,220,879 | 6/1993 | Johnson | 114/219 |

*Primary Examiner*—Stephen Avila

*Attorney, Agent, or Firm*—Patent Law Offices of Rick Martin, P.C.

[57] ABSTRACT

A hinged multiple fender assembly (62) for protecting boats from damage in the marine environment. Hinged multiple fender assembly (62) is comprised of one or more hinged modular marine fender units (20). Portable hinged modular marine fender unit (20) has a fender body (22) with a top mount hole (24) and bottom mount hole (26) for temporary and permanent mounting to boats, docks and other marine mounting surfaces. Hinged multiple fender assembly (62) is formed by linking top hinge segment (28) and bottom hinge segment (30) on first hinged modular marine fender unit (20) to middle hinge segment (32) on second hinged modular marine fender unit (20) with hinge attachment bolt (54). Any number of hinged modular marine fender units (20) can be combined to form hinged multiple fender assembly (62). Hinged multiple fender assembly (62) can be shaped around any irregular surface to form a protective assembly.

3 Claims, 15 Drawing Sheets

CONTINUOUSLY MODULAR FLEXIBLY HINGED MARINE FENDER SYSTEM

BACKGROUND—FIELD OF INVENTION

This invention relates to the field of protective marine fenders, specifically to modular marine fender systems.

BACKGROUND—DESCRIPTION OF PRIOR ART

Marine vessels often suffer significant and costly damage when moored to fixed objects in the rugged marine environment. As a result, boaters have historically made significant investments in marine fender systems designed to protect a moored boat.

Boats are moored to a wide variety of marine objects, including docks, break-walls, and other boats. The sharp angles and compound curves found in the marine environment make it difficult to fit currently available fenders properly around docking structures. As a result, an inspection of most waterways will show a proliferation of jury-rigged contraptions that have been contrived in an attempt to protect a vessel from these structures.

Many fender systems are designed to be tied to a railing or cleat on the boat hull. This results in a fender that tends to move and shift when the boat is in motion on active water, rendering it useless. Currently available fenders fail to make use of the mooring cover snaps on a boat hull to lock a fender in place so it will not move.

A boat hull often suffers significant damage and scarring when it contacts bottom in low water conditions or is beached. A boat can also suffer damage, when "rafted" together with other boats in open water. No currently available fender system adequately protects a boat in both of these situations.

The many different types of application specific fender systems on the market are distinguished by their lack of portability and modularity. Permanently mounted dock fenders can not be interchangeably used as portably mounted boat fenders, or vice-versa. These fenders are unable to be applied in an interchangeable fashion as docking requirements change. This lack of modularity prevents the combination of multiple units to achieve a customized fit.

Many fender systems use a generic design in an attempt to permit as broad an application as possible. This approach often results in a fender that does not securely mount in place and has a limited area of coverage. As a result the fender is eventually displaced by continuous movement of the boat in such a manner as to render it ineffective.

Fender systems are often created as large as possible to overcome these problems. However, these large fenders are limited in application, consume large amounts of storage space, and are still unable to protect the boat properly. Additionally, large marine fenders prevent customized fit and placement, are difficult to employ, and often result in less than optimal mooring arrangements.

As a result, expensive custom fender units must be developed to protect a specific boat or dock configuration adequately.

All marine fenders previously known suffer from a number of disadvantages:

(a) They are very application specific and are unable to be interchangeably applied in a modular fashion to any mooring surface as need requires.

(b) They are unable to provide an adaptable and contoured fit around the many comers and sharp angles found in a marine environment.

(c) There is no currently available portable modular marine fender system that can be temporarily mounted to a boat hull using mooring cover snaps.

(d) There is no currently available portable modular marine fender system that can protect the keel of a boat in low water conditions and protect multiply moored boats in open water.

(e) They are unable to provide a portable modular system that can be permanently and temporarily mounted on both fixed docking structures and boats.

(f) An expensive custom fender must often be developed to protect a specific boat or dock configuration adequately.

(g) Many fender designs are difficult to use and install.

OBJECTS AND ADVANTAGES

Accordingly, besides the objects and advantages of the marine fender system described above, several objects and advantages of the present invention are:

(a) to provide a multiple application hinged modular marine fender system that can be interchangeably applied to any mooring surface;

(b) to provide an adaptable hinged modular marine fender system with a flexible hinge allowing multiple fender units to be contour fit and immovably secured around the many comers and sharp angles found in a marine environment;

(c) to provide a portable hinged modular marine fender system that can be temporarily mounted to a boat hull using mooring cover snaps or mooring lines;

(d) to provide a portable hinged modular marine fender system that can protect the keel of a boat in low water conditions and also protect multiply moored boats in open water;

(e) to provide a portable hinged modular marine fender system that can be permanently or temporarily mounted on both fixed docking structures and boats;

(f) to provide an inexpensive customizable hinged modular marine fender system that is able to effectively support specialized boat and dock configurations; and (g) to provide a hinged modular marine fender system that is easy to use and install.

Further objects and advantages are to provide a hinged modular marine fender system that is able to withstand the impacts and shocks associated with the marine environment, and to provide a hinged modular marine fender system that is inexpensive and simple to manufacture. Still further objects and advantages of my invention will become apparent from a consideration of the drawings and ensuing description.

DRAWING FIGURES

The invention, both as to organization and method of practice, together with other objects and advantages thereof, will best be understood by reference to the following description, taken in connection with the accompanying drawings, in which.

Figure 3:
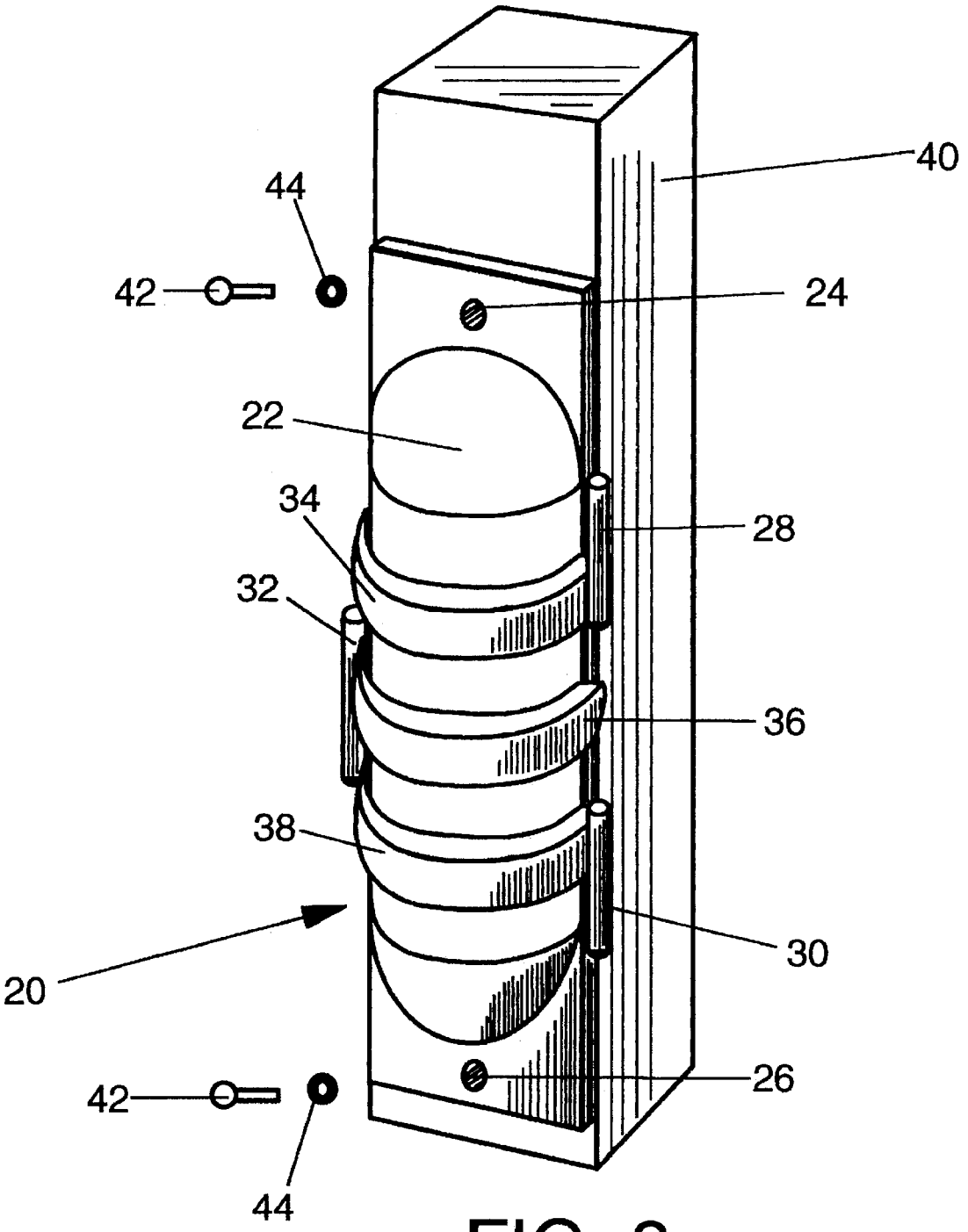
Figure 4:
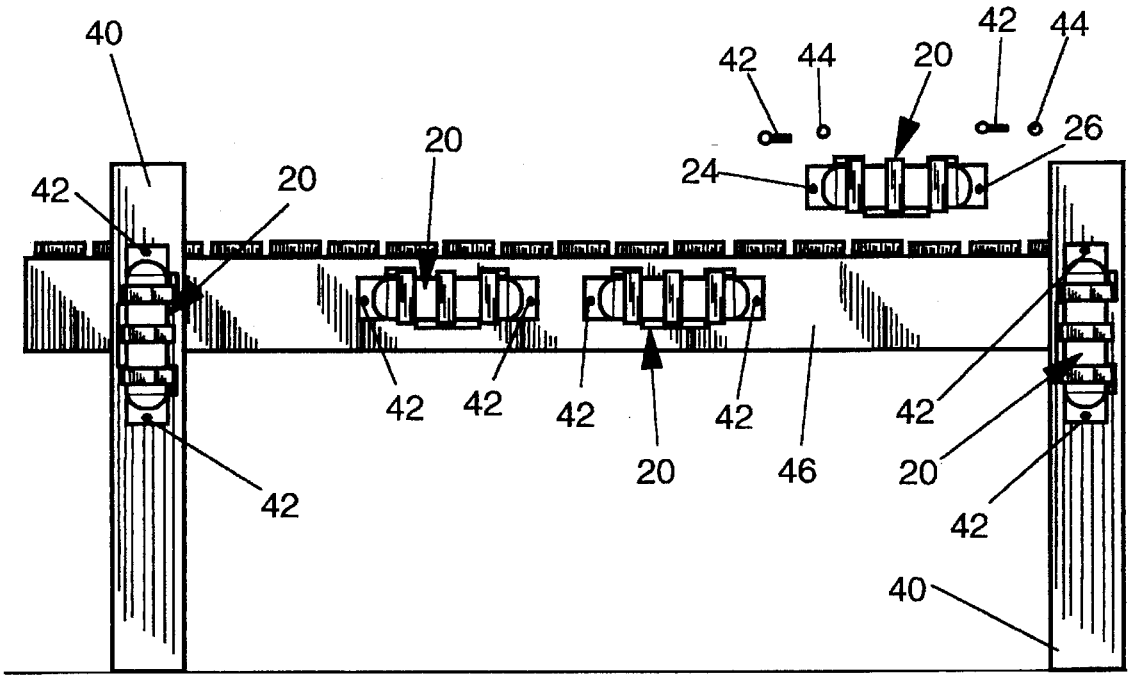
Figure 5:
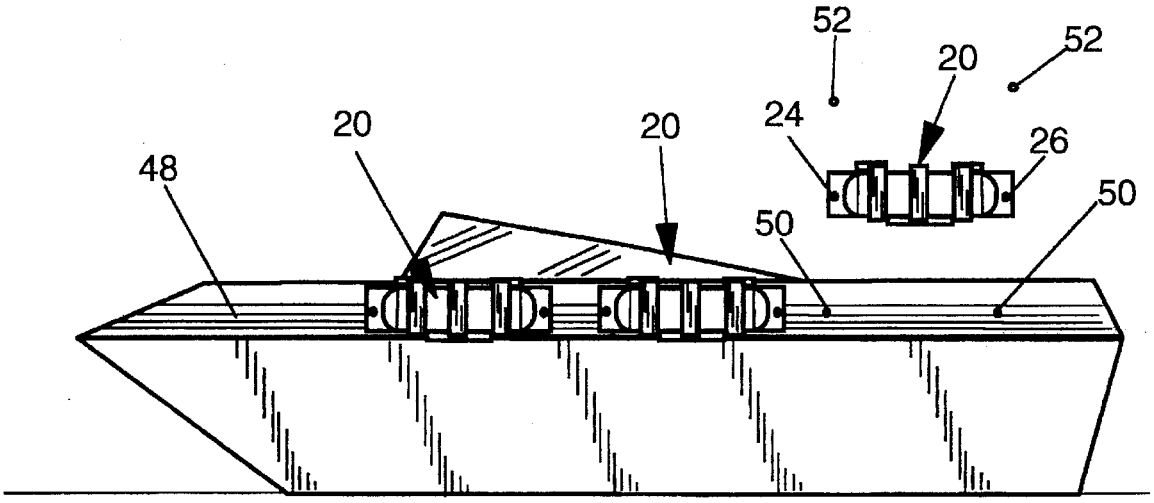
Figure 6:
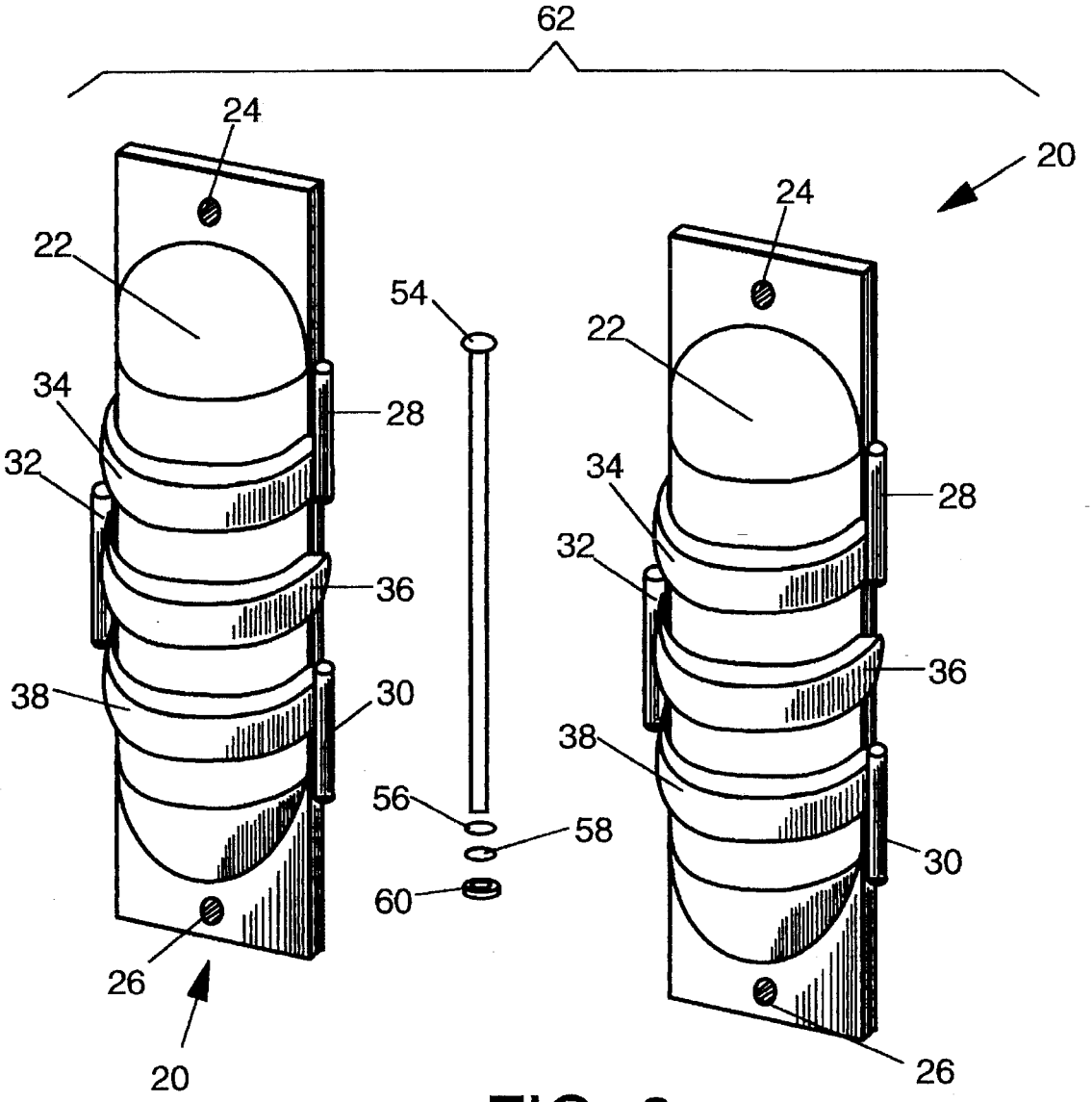
Figure 7:
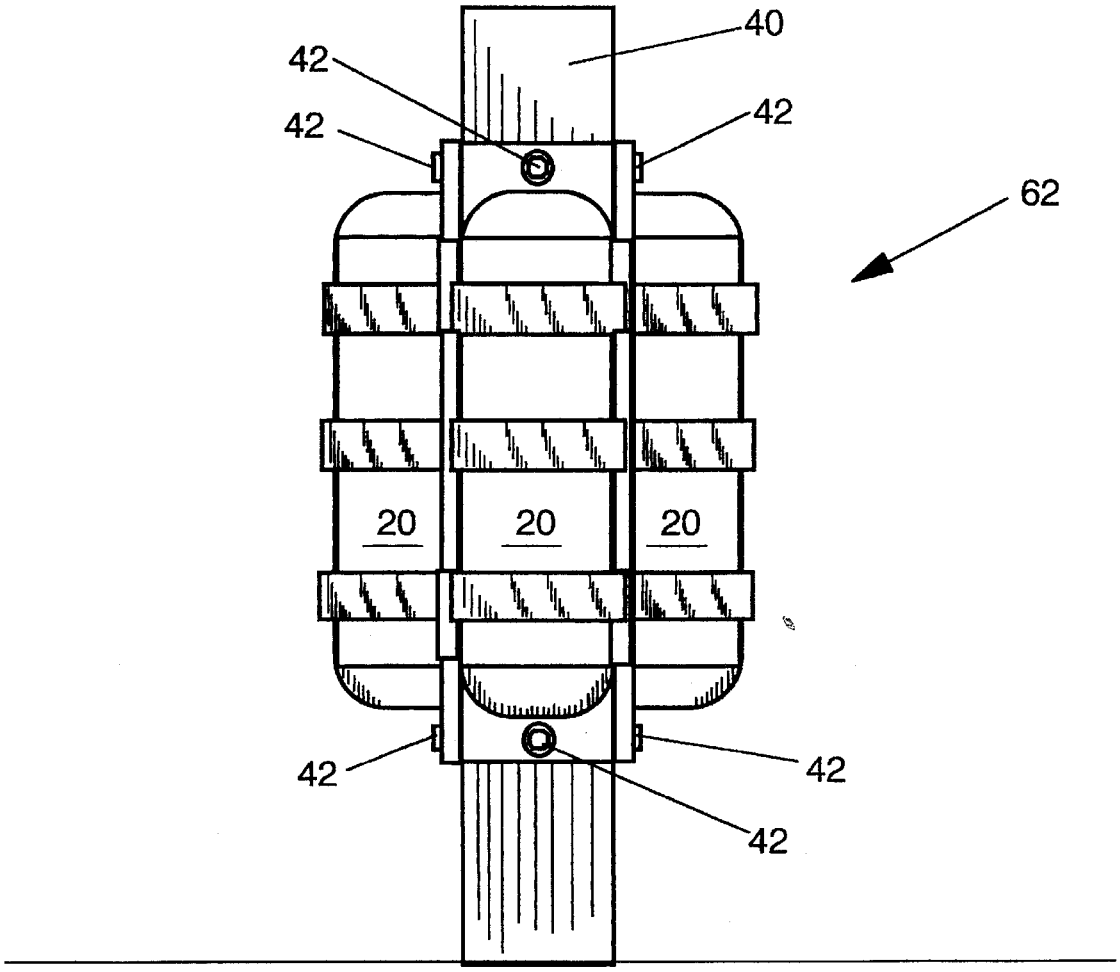
Figure 8:
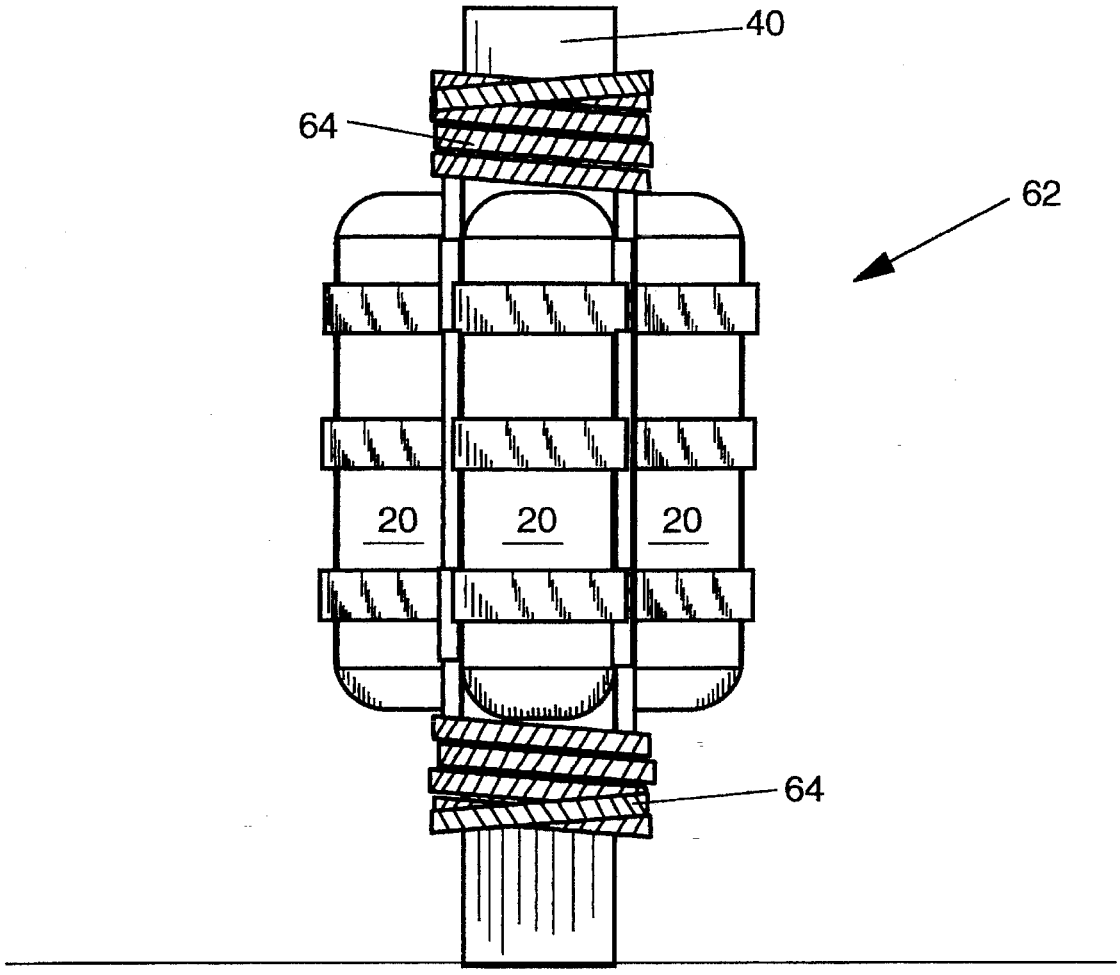
Figure 9:
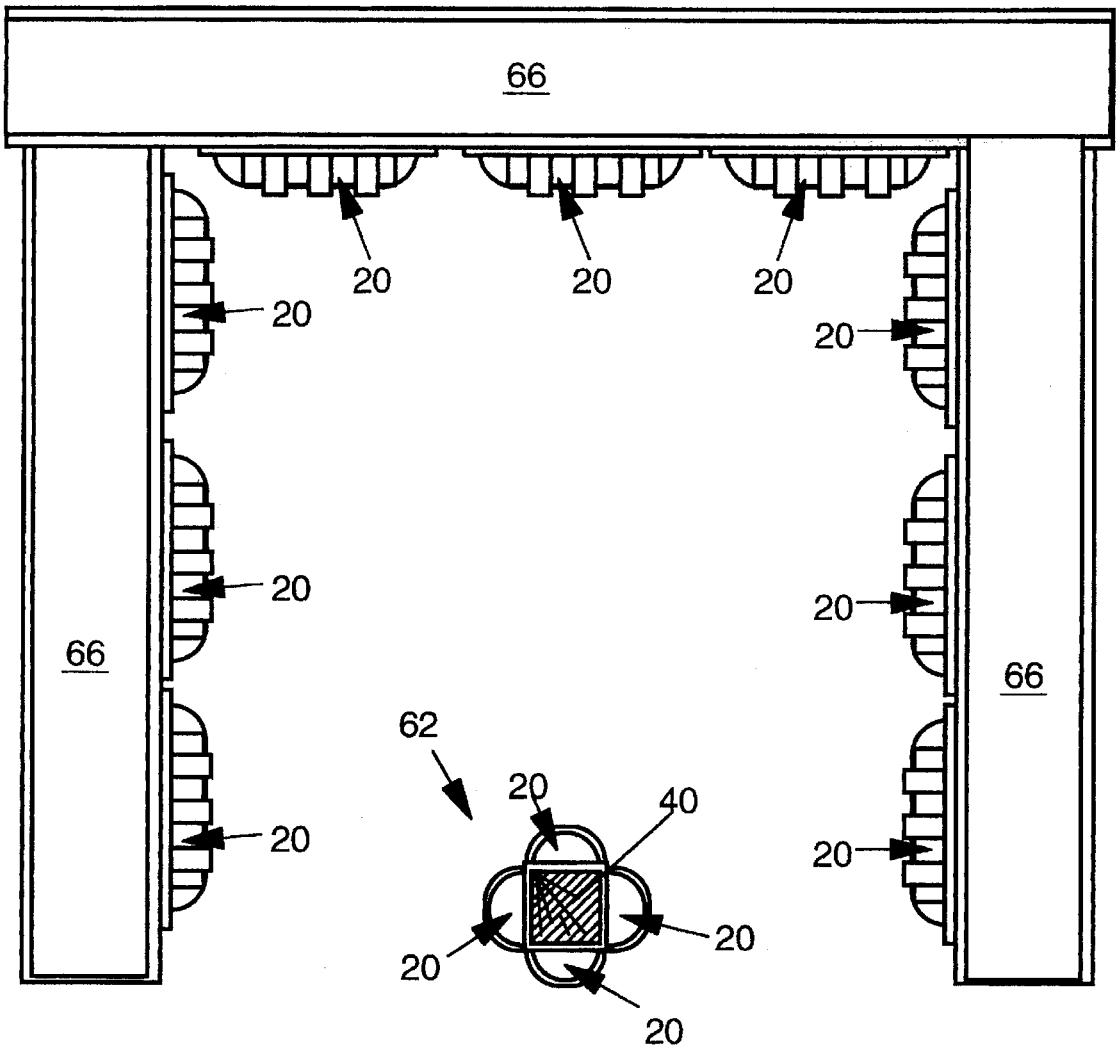
Figure 10:
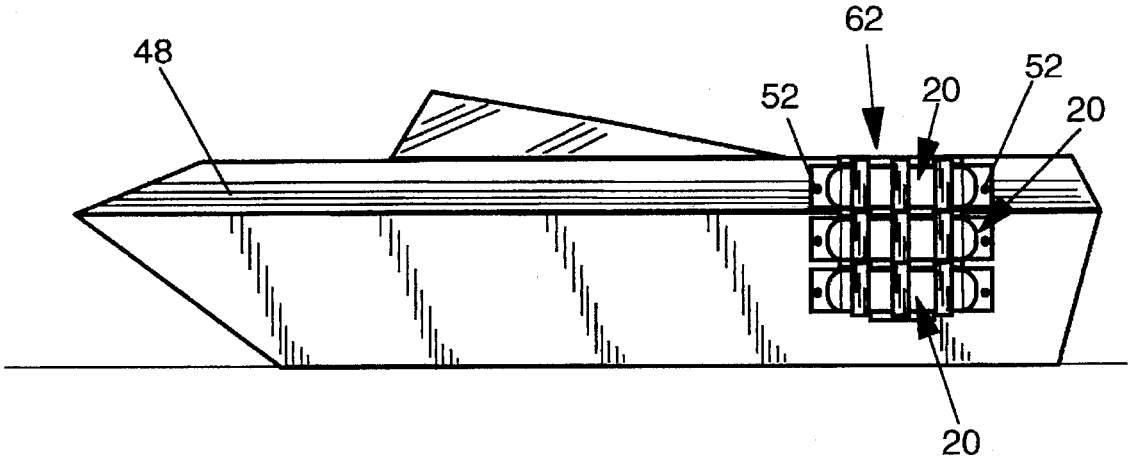
Figure 11:
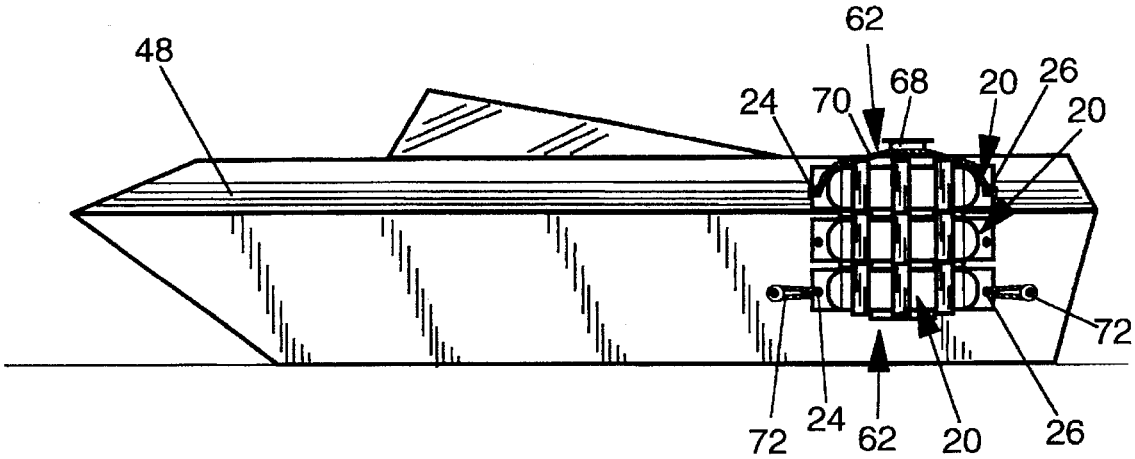
Figure 12:
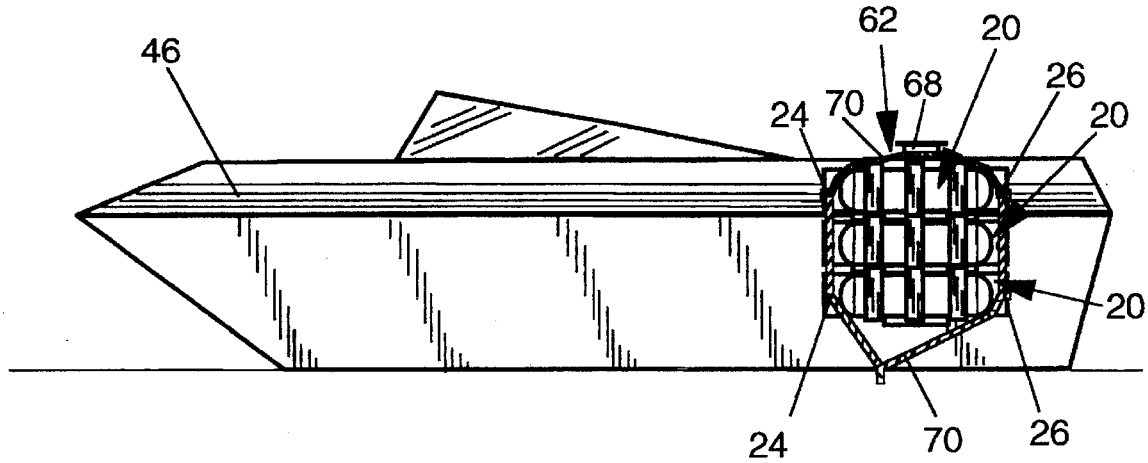
Figure 13:
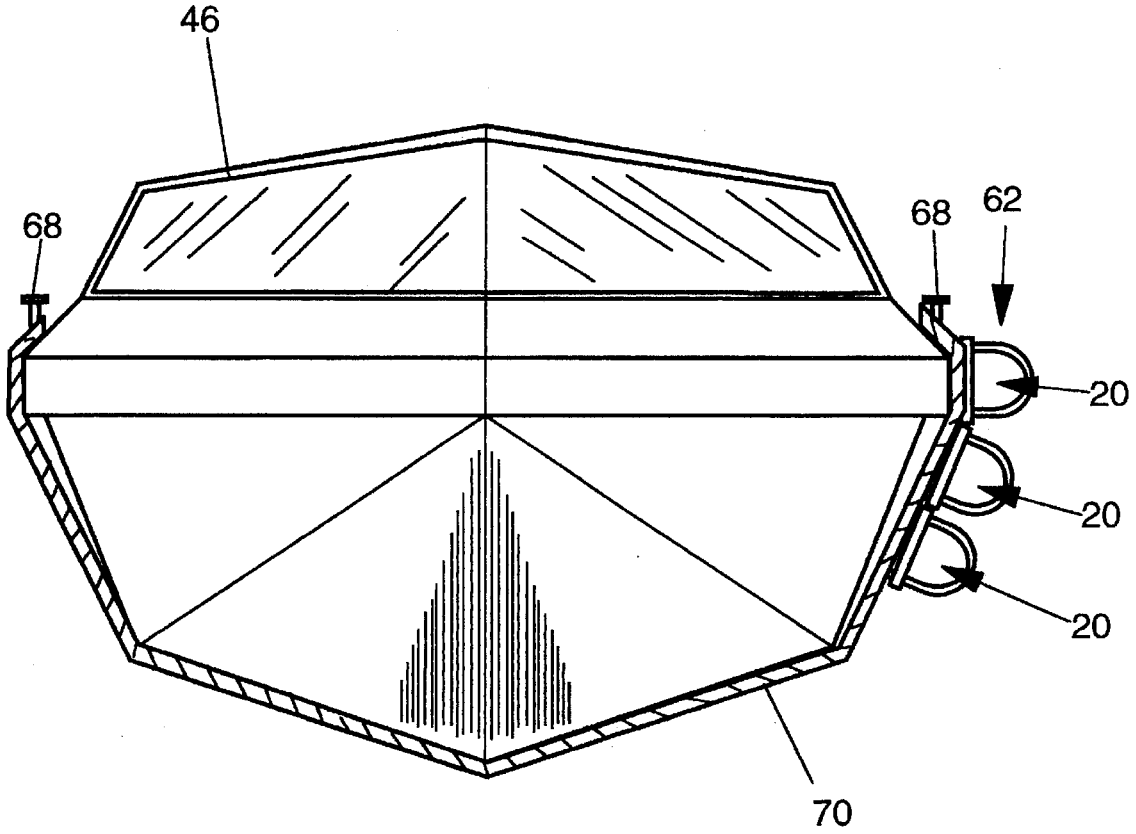
Figure 14:
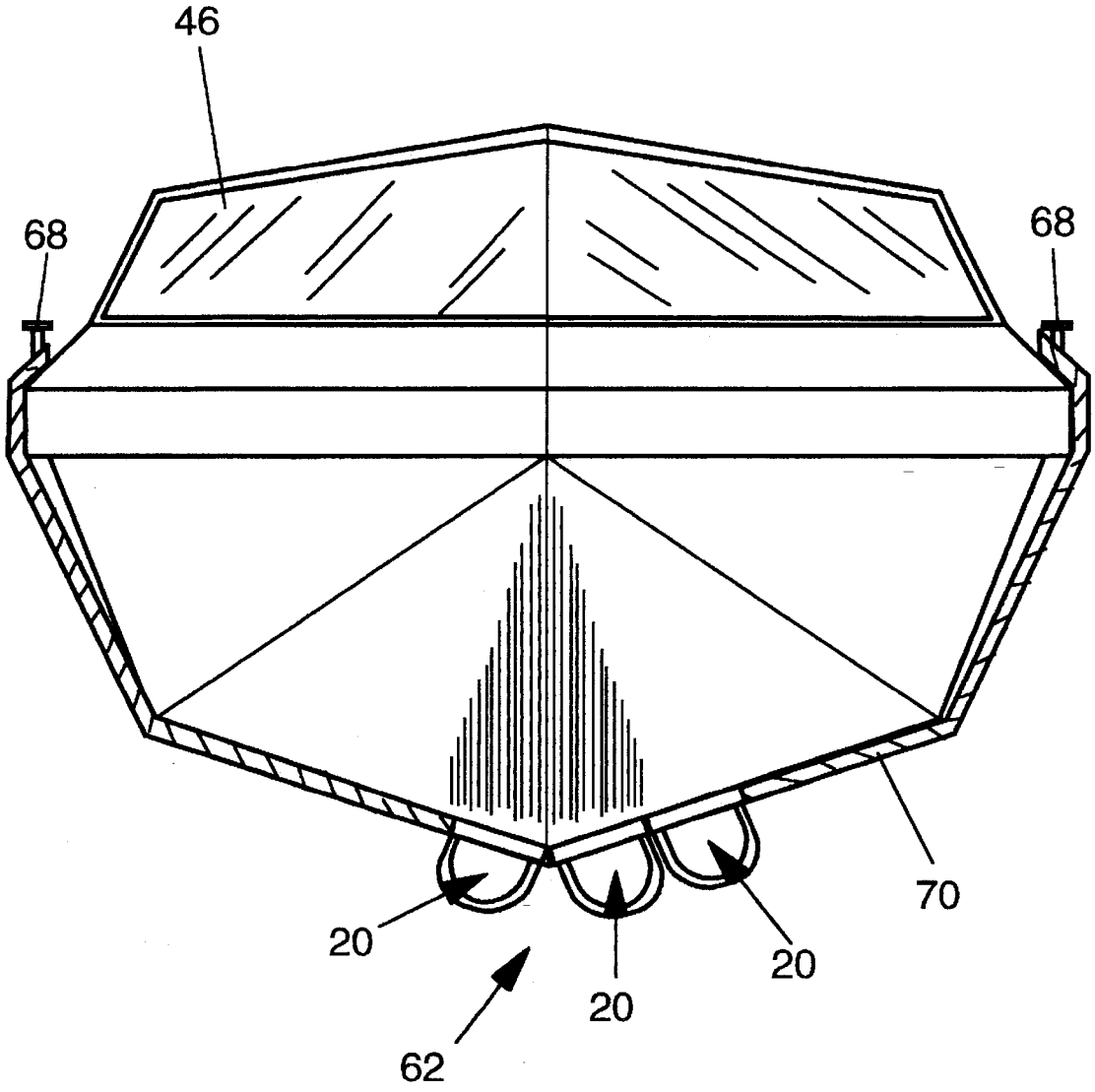
Figure 15:
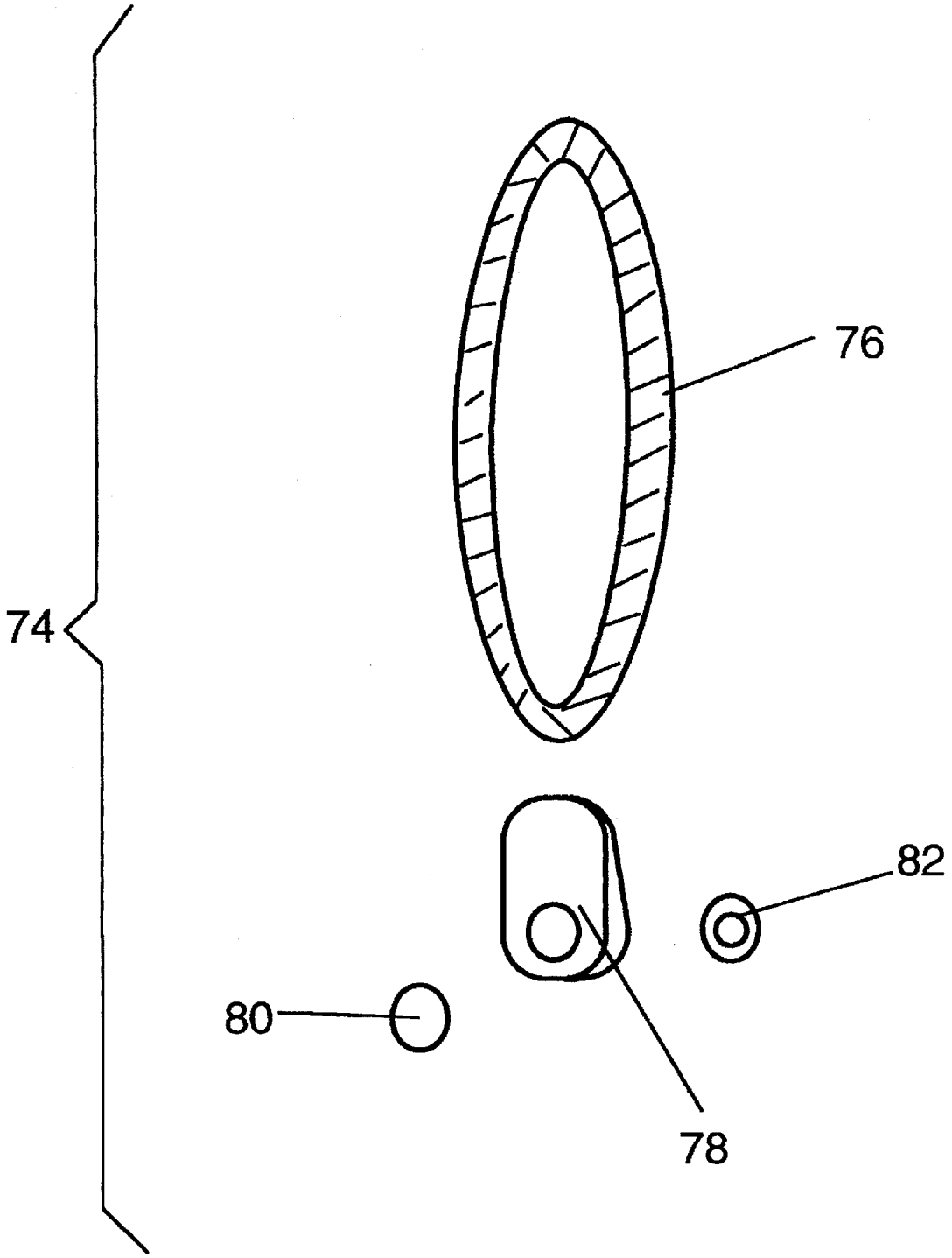

FIG. 3 is a perspective view of the hinged modular marine fender unit attached to a wooden dock post, FIG. 4 is a side elevation view of the hinged modular marine fender unit attached to a dock section, FIG. 5 is a side elevation view of multiple hinged modular marine fender units temporarily mounted to a boat using mooring cover snaps, FIG. 6 is a perspective view of a hinged multiple fender assembly, FIG. 7 is a front elevation view of a hinged multiple fender assembly permanently mounted to a dock post using bolts, FIG. 8 is a front elevation view of a hinged multiple fender assembly temporarily mounted to a dock post using rope, FIG. 9 is a plan view of a hinged multiple fender assembly mounted to a dock post and individual modular marine fender units mounted to berth sections, FIG. 10 is a side elevation view of a hinged multiple fender assembly temporarily mounted to a boat using mooring cover snaps, FIG. 11 is a side elevation view of a hinged multiple fender assembly temporarily mounted to a boat and restricted from movement by retaining straps, FIG. 12 is a side elevation view of a hinged multiple fender assembly temporarily mounted to a boat and restricted from movement by a mooring line passed under the hull of the boat, FIG. 13 is a front elevation view of a hinged multiple fender assembly temporarily mounted to a boat and restricted from movement by a mooring line passed under the hull of the boat, FIG. 14 is a front elevation view of a hinged multiple fender assembly secured about the keel of a boat to protect the boat when beached or in low water conditions, and FIG. 15 is an exploded perspective view of a quick mount connector for easily carrying and mounting modular marine fender unit.

Reference Numerals in Drawings

| | |
|---|---|
| 20 hinged modular marine fender unit | 22 fender body |
| 24 top mount hole | 26 bottom mount hole |
| 28 top hinge segment | 30 bottom hinge segment |
| 32 middle hinge segment | 34 top rub strip |
| 36 middle rub strip | 38 bottom rub strip |
| 40 wooden post | 42 mounting bolt |
| 44 mounting washer | 46 dock section |
| 48 boat | 50 mooring cover male snap connector |
| 52 female snap connector | 54 hinge attachment bolt |
| 56 top attachment washer | 58 bottom attachment washer |
| 60 hinge attachment nut | 62 hinged multiple fender assembly |
| 64 fender attachment rope | 66 berth section |
| 68 deck cleat | 70 mooring line |
| 72 secure mount line | 74 quick mount connector |
| 76 looped elastic line | 78 material patch |
| 80 female snap connector | 82 male snap connector |

DESCRIPTION OF THE PREFERRED EMBODIMENT

To create a marine fender system capable of withstanding the elements associated with the marine environment, the overall philosophy and design concept considered the following:

Ability to withstand impact;

Ability to withstand extremes of temperature;

Imperviousness to moisture;

Light weight;

Scaleable and modular in design;

To achieve these goals, advantage has been taken of molded form technology. Conventional manufacturing techniques are used which are within the knowledge of those skilled in the art.

Figure 1:
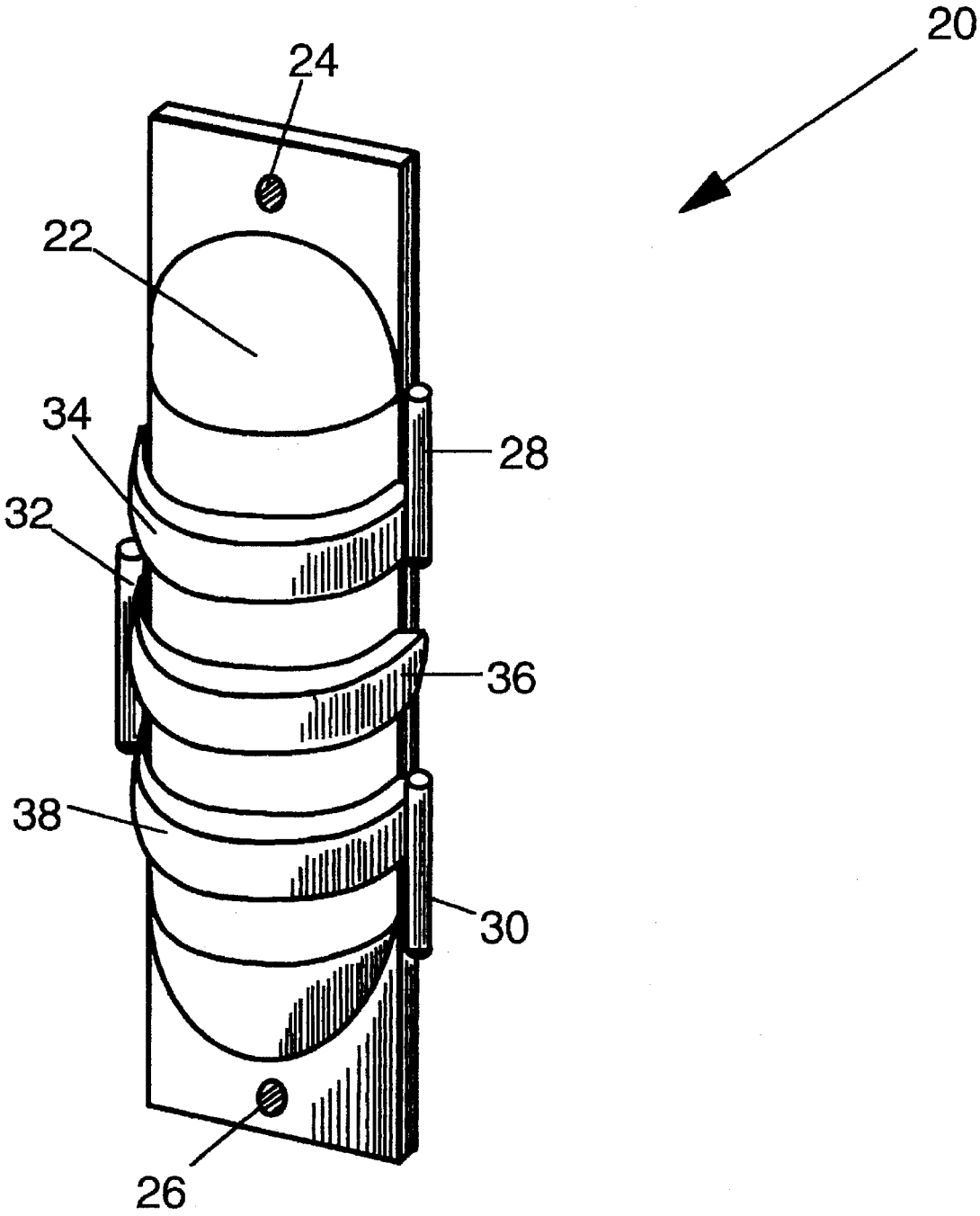
FIG. 1 is a perspective view of the hinged modular marine fender unit.
Figure 2:
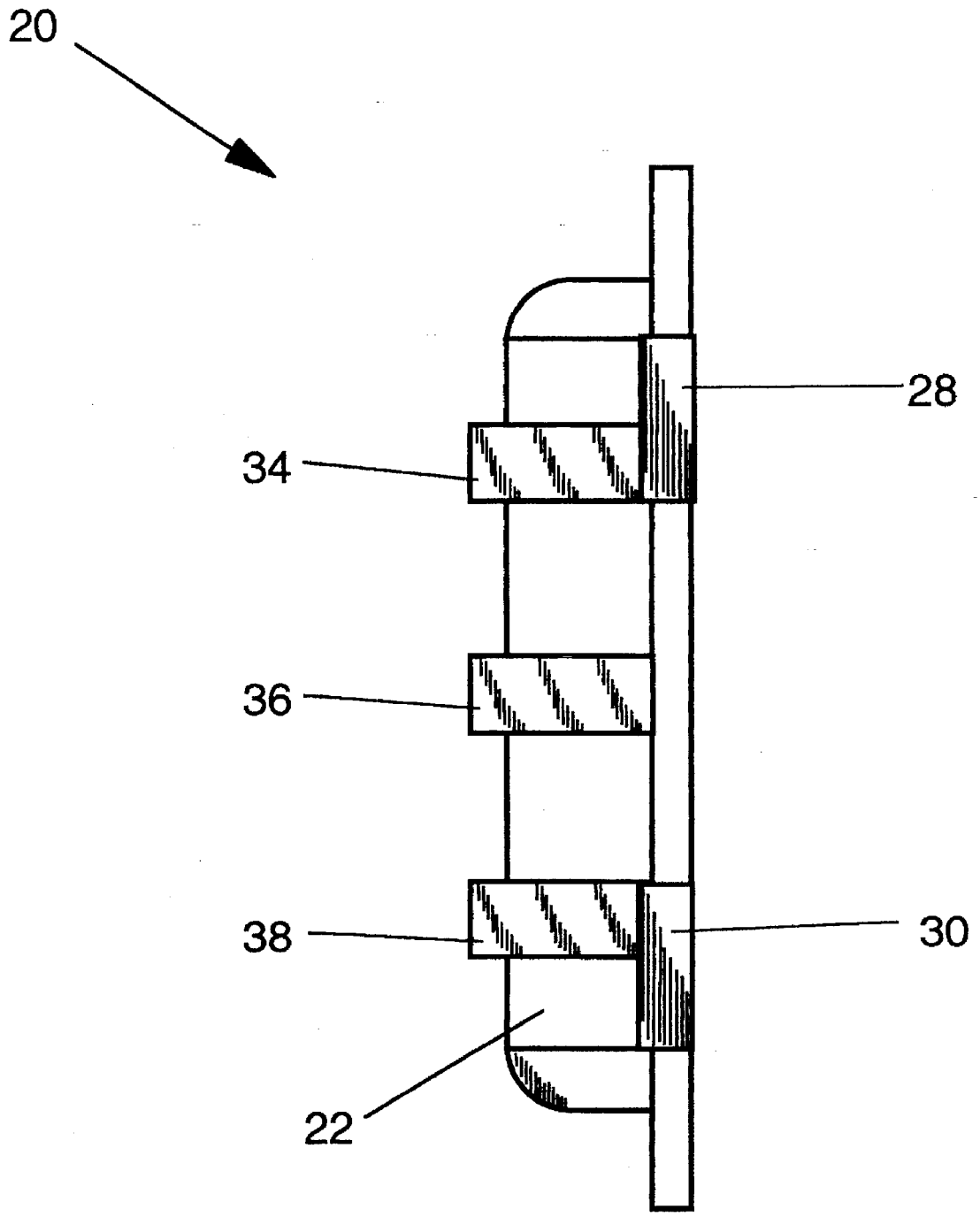
FIG. 2 is a side elevation view of the hinged modular marine fender unit.

A preferred embodiment of a hinged modular marine fender unit 20 is illustrated in FIGS. 1 and 2 of the drawing. Hinged modular marine fender unit 20 is comprised of a fender body 22, a top mount hole 24, a bottom mount hole 26, a top hinge segment 28, a bottom hinge segment 30, a middle hinge segment 32, a top rub strip 34, a middle rub strip 36, and a bottom rub strip 38. In the preferred embodiment, hinged modular marine fender unit 20 is a light-weight, water-resistant, air impervious molded form.

Fender body 22 has a flat back surface to facilitate flush mounting to marine surfaces such as dock structures or boat bodies. Top mount hole 24 and bottom mount hole 26 provide surface mounting capabilities for hinged modular marine fender unit 20. Permanent mounting of hinged modular marine fender unit 20 is described in detail with reference to FIGS. 3 and 4. Temporary mounting is described in detail with reference to FIG. 5.

The rounded from surface of fender body 22 allows a boat to slip off hinged modular marine fender unit 20 when movement occurs in turbulent water. Rub strips 34, 36, and 38 provide a movement limiting effect on contacting surfaces, as well as cushion fender body 22 from excessive wear and tear. Top hinge segment 28, bottom hinge segment 30, and middle hinge segment 32 on either side of fender body 22 are used to link hinged modular marine fender unit 20 to other hinged modular marine fender units 20. This linkage process is described in detail with reference to FIG. 6.

Referring now to FIG. 3, hinged modular marine fender unit 20 is permanently attached to a wooden post 40 using a mounting bolt 42 and a mounting washer 44 placed through top mount hole 24 and bottom mount hole 26. When applied in this fashion, hinged modular marine fender unit 20 provides protection for boats moored next to wooden post 40.

Referring now to FIG. 4, hinged modular marine fender unit 20 is permanently mounted to a dock section 46 and wooden post 40 using mounting bolt 42 and mounting washer 44 placed through top mount hole 24 and bottom mount hole 26. When used in this manner, hinged modular marine fender unit 20 prevents the hull of a moored boat from contacting dock section 46 or wooden post 40.

Referring now to FIG. 5, hinged modular marine fender unit 20 is shown mounted to a boat 48. A mooring cover male snap connector 50 is permanently mounted to the hull of boat 48. Mooring cover male snap connector 50 is positioned to align with top mount hole 24 and bottom mount hole 26.

Hinged modular marine fender unit 20 is secured by mating a female snap connector 52 through top mount hole 24 and bottom mount hole 26 with mooring cover male snap connector 50. When used in this fashion, hinged modular marine fender unit 20 is stored in boat 48 until required, and is mounted when boat 48 is moored at dock or moored with another boat in open water.

Referring now to FIG. 6, a hinged multiple fender assembly 62 is shown. Hinged multiple fender assembly 62 is comprised of two or more hinged modular marine fender units 20 linked by a hinge attachment bolt 54, a top attachment washer 56, a bottom attachment washer 58, and a hinge attachment nut 60. In the preferred embodiment, hinge attachment bolt 54, top attachment washer 56, bottom attachment washer 58, and hinge attachment nut 60 are made of a corrosion resistant metal alloy.

Top hinge segment 28 and bottom hinge segment 30 on first hinged modular marine fender unit 20 are vertically aligned with middle hinge segment 32 on second hinged modular marine fender unit 20. Hinge attachment bolt 54 is passed through top attachment washer 56, top hinge segment 28, middle hinge segment 32, bottom hinge segment 30, bottom attachment washer 58, and finally secured with hinge attachment nut 60.

In this configuration, hinged multiple fender assembly 62 creates a fender surface that can be formed around a variety of irregular surfaces. Top hinge segment 28, bottom hinge segment 30, and middle hinge segment 32 are instrumental in securing hinged multiple fender assembly 62 along comers and edges of mounting surfaces.

Referring now to FIG. 7, hinged multiple fender assembly 62 is shown being comprised of three hinged modular marine fender units 20. The flat back surface of each modular fender unit 20 permits alignment with wooden post 40.

Each hinged modular fender unit 20 is permanently attached to wooden post 40 with mounting bolts 42 and mounting washers 44 (as described previously in relation to FIG. 3) placed through top mounting hole 24 (not shown) and bottom mounting hole 26 (not shown). When used in the method, boats are protected from contacting the surface of wooden post 40 when mooring from multiple positions, or when mooring in turbulent water.

Referring now to FIG. 8, hinged multiple fender assembly 62 is temporarily attached to wooden post 40 with a fender attachment rope 64. Fender attachment rope 64 secures hinged multiple fender assembly 62 around wooden post 40. Fender attachment rope 64 also limits the movement of hinged multiple fender assembly 62 in a vertical direction.

The flat back surface of each hinged modular fender unit 20 allows alignment with wooden post 40. Each hinged modular marine fender unit 20 is connected to the next hinged modular fender unit 20 using hinge attachment bolt 54 (not shown, described previously in relation to FIG. 6). Top hinge segment 28, bottom hinge segment 30, and middle hinge segment 32 on each hinged modular marine fender unit 20 act to lock hinged multiple fender assembly 62 in place around the sharply angled perimeter of wooden post 40.

When used in this manner, hinged multiple fender assembly 62 is stored in the boat and temporarily attached to wooden post 40 when mooring. Upon departure hinged multiple fender assembly 62 is retrieved from wooden post 40 and returned to storage in the boat.

Referring now to FIG. 9, a dock slip has a berth section 66. Multiple hinged modular marine fender units 20 are permanently attached to each berth section 66. It will be understood that the method of attachment is identical to the method of attachment outlined previously in FIGS. 3 and 4.

Hinged multiple fender assembly 62 is shown permanently attached to wooden post 40. It will also be understood that the method of attachment is identical to the method of attachment outlined previously in FIG. 7. When used in this manner, hinged modular marine fender unit 20 protects both boats moored in the slip as well as boats approaching the slip.

Referring now to FIG. 10, hinged multiple fender assembly 62 is shown temporarily mounted to a boat 48. It will be understood that the top hinged modular marine fender unit 20 is secured to mooring cover male snap connector 50 using female snap connector 52 as previously discussed in reference to FIG. 5.

It will also be understood that the middle and bottom hinged modular marine fender units 20 are secured through hinge and bolt connections discussed previously in reference to FIG. 6. The middle and bottom hinged modular marine fender units 20 are able to move freely. In this application hinged multiple fender assembly 62 is used to protect two boats temporarily mooring in open water.

Referring now to FIG. 11, a hull mounted deck cleat 68 on boat 48 is used to support hinged multiple fender assembly 62. A mooring line 70 is passed through top mount hole 24 and bottom mount hole 26 in top hinged modular marine fender unit 20. A set of secure mount lines 72 are connected to male snaps (not shown) mounted on the hull boat 48.

Each secure mount line 72 is then tied to top mount hole 24 and bottom mount hole 26 in the bottom hinged modular marine fender unit 20. It will be understood that the middle and bottom hinged modular marine fender units 20 are secured through hinge and bolt connections discussed previously in reference to FIG. 6.

The middle and bottom hinged modular marine fender units 20 are prevented from moving freely. When used in this fashion hinged multiple fender assembly 62 is used to protect two boats mooring in open water for extended periods of time Referring now to FIGS. 12 and 13, hull mounted deck cleat 68 on boat 48 is used to support hinged multiple fender assembly 62. Mooring line 70 is passed through top mount hole 24 and bottom mount hole 26 in all hinged modular marine fender units 20 in hinged multiple fender assembly 62.

It will be understood that the middle and bottom hinged modular marine fender units 20 are secured through hinge and bolt connections discussed previously in reference to FIG. 6. Mooring line 70 is then passed under the hull of boat 48 and secured to hull mounted deck cleat 68 on the opposite side. When used in this fashion, hinged multiple fender assembly 62 is used to protect two boats temporarily moored in open water, or to protect a boat when docking.

Referring now to FIG. 14, hinged multiple fender assembly 62 is secured about the keel of boat 48. Mooring line 70 is passed through top mount hole 24 and bottom mount hole 26 (not shown) in all hinged modular marine fender units 20 in hinged multiple fender assembly 62. It will be understood that the middle and bottom hinged modular marine fender units 20 are secured through hinge and bolt connections discussed previously in reference to FIG. 6.

Mooring line 70 is secured to hull mounted deck cleat 68 on either side of boat 48. When used in this manner, hinged multiple fender assembly 62 would protect the bottom of boat 48 when anchored in shallow water or when beached. The flat surfaces and hinges of hinged modular marine fender units 20 would assist in maintaining the desired position of hinged multiple fender assembly 62.

Referring now to FIG. 15, a quick mount connector 74 for modular marine fender unit 20 is comprised of a looped elastic line 76, a material patch 78, a female snap connector 80, and a male snap connector 82. Material patch 78 is folded about looped elastic line 76 and secured to top mount hole 24 or bottom mount hole 26 in hinged modular marine fender unit 20 (not shown) by mating male snap connector 82 and female snap connector 80. Quick mount connector 74 permits hinged modular fender unit 20 to be easily carried as well as temporarily mounted to multiple mooring surfaces.

Operation

Accordingly, the operation of the preferred embodiment of the modular marine fender system in the present invention should be apparent from the following description. Hinged modular marine fender unit 20 is used in a singular fashion and is attached permanently to wooden post 40 and dock section 46 (FIGS. 3 and 4). When used in such a fashion, continuous protection is provided for any moored vessel.

Hinged modular marine fender unit 20 (FIG. 5) can also be mounted temporarily to the hull of boat 48. Hinged modular marine fender unit 20 is securely stowed within boat 48 when it is not in use. When mooring, hinged modular marine fender unit 20 is removed from storage and temporarily mounted to the hull of boat 48. When mooring is complete, hinged modular marine fender unit 20 can be removed from the hull of boat 48 and returned to storage.

Hinged multiple fender assemblies 62 (FIG. 7) can be permanently mounted to wooden dock post 40 using mounting bolt 42 and mounting washer 44. If permanent mounting is not required, or when mooring temporarily, hinged multiple fender assembly 62 (FIG. 8) can be secured to dock post 40 using fender attachment rope 64.

Hinged modular marine fender unit 20 and hinged multiple fender assembly 62 (FIG. 9) can be mounted permanently to wooden post 40 and berth section 66 to provide protection for moored boats and those approaching the dock slip.

Hinged multiple fender assembly 62 (FIG. 10) can be secured to the hull of boat 48 for temporary mooring or when mooring to a dock in calm water. When mooring in rougher water or for extended periods of time in open water with another boat, hinged multiple fender assembly 62 (FIG. 11) can be secured from movement by attaching secure mount lines 72 to male snaps on the hull of boat 48.

Multiple fender assembly 62 (FIGS. 12 and 13) can also be used during temporary mooring of boats in open water. In those situations where secure mount lines 72 (referred to previously) are not needed, hinged multiple fender assembly 62 can be temporarily secured by passing mooring line 70 to the other side of boat 48. There it can be tied to hull mounted deck cleat 68 or simply held by hand until mooring is complete.

When approaching shore or shallow water, hinged modular fender assembly 62 (FIG. 14) can be drawn under the hull of boat 48 and secured in a position to protect the keel from damage. When departing, hinged modular fender assembly 62 can be pulled back into boat 48.

Hinged modular marine fender unit 20 can be easily carried by using quick mount connector 74 (FIG. 15). Looped elastic line 76 can also be used in a temporary fashion to mount hinged modular marine fender unit 20 to a dock post, deck cleat, or other similar objects.

Summary, Ramifications and Scope

Accordingly, the reader will see that the hinged modular marine fender system of this invention can be interchangeably applied to any mooring surface, can be used to protect the keel of a boat, and can be used to protect multiply moored boats in open water. In addition, it can be temporarily mounted to a boat hull using mooring cover snaps or mooring lines. Furthermore, the hinged modular marine fender system has additional advantages in that

- it allows multiple fender units to be contour fit and immovably secured around the many comers and sharp angles found in a marine environment;
- it can both be permanently or temporarily mounted on fixed docking structures;
- it is easily and inexpensively customizable for specialized boat and dock configurations;
- it is easy to use and install;
- it is able to withstand the shocks and impacts associated with the marine environment; and
- it is inexpensive and simple to manufacture.

It will be apparent from the foregoing description that the hinged modular marine fender system of the invention provides a safe, economic, and highly reliable method for protecting a moored boat in a wide variety of docking situations.

Although the description above contains many specificity's, these should not be construed as limiting the scope of the invention but as merely providing illustrations of some of the presently preferred embodiments of this invention. For example,the modular marine fender unit can have other shapes, sizes, and styles. The same unit, in its preferred embodiment, can easily be adapted to other uses. Many modifications and variations are possible considering the above teaching.

Thus the scope of the invention should be determined by the appended claims and their legal equivalents, rather than by the examples given.

I claim:

1. A modular bumper system comprising:

a planar backboard member;

a bumper mounted to a front surface of the planar backboard member;

a hinge means functioning to join two planar backboard members together;

said planar backboard member further comprising a hole means functioning to receive a rope and a snap and a bolt, thereby providing a means to mount the planar backboard member on a post and a dock and a boat and a snap mounted on a boat;

a pair of cleats mounted one on each side of a boat;

a plurality of hinged planar backboard members; and a cord means functioning to connect the plurality of hinged planar members to an underside of a boat.

2. The system of claim 1, wherein said hinge means further comprises quick-connect means functioning to connect said planar backboard members whereby said planar backboard members may be easily connected and disconnected.

3. The system of claim 1, wherein said hinge means further comprises:

cylinder housings located along an edge of said planar backboard members;

a rod means removably inserted in said cylinder housings functioning to connect said planar backboard members together whereby said planar backboard members may freely rotate about said rod means.

* * * * *